United States Patent [19]

Janke et al.

[11] Patent Number: 4,707,684

[45] Date of Patent: Nov. 17, 1987

[54] ALARM FOR A REFRIGERATOR

[75] Inventors: Donald E. Janke, Benton Township, Berrien County; William J. Linstromberg, Lincoln Township, Berrien County, both of Mich.

[73] Assignee: Whirlpool Corporation, Benton Harbor, Mich.

[21] Appl. No.: 810,856

[22] Filed: Dec. 18, 1985

[51] Int. Cl.[4] ..... G08B 23/00; G08B 17/00

[52] U.S. Cl. ..... 340/530; 62/131; 340/585; 200/61.62

[58] Field of Search ..... 340/585, 530, 545, 384 E, 340/52 D; 62/131; 200/61.62, 237–238, 290, 5 A

[56] References Cited

U.S. PATENT DOCUMENTS

| | | | |
|---|---|---|---|
| 3,971,017 | 7/1976 | Sutcliffe et al. | 340/384 E |
| 4,160,972 | 7/1979 | La Mell et al. | 340/541 |
| 4,387,578 | 6/1983 | Paddock | 62/127 |
| 4,468,542 | 8/1984 | Pounds | 200/5 A |
| 4,515,999 | 5/1985 | Harper | 200/5 A |

*Primary Examiner*—Glen R. Swann, III
*Assistant Examiner*—Thomas J. Mullen, Jr.
*Attorney, Agent, or Firm*—Wood, Dalton, Phillips, Mason & Rowe

[57] ABSTRACT

An alarm is disclosed herein for providing an indication when a certain condition, such as a door ajar condition of a refrigerator, has existed for a predetermined time. The alarm includes a capacitor, means coupled to the capacitor for charging same while the certain condition is in existence, an indicating device and a voltage sensitive switch coupled to the capacitor and to the indicating device for repetitively partially discharging the capacitor through the indicating device when the charge on the capacitor reaches a particular level. A series of alarm pulses are thereby developed by the indicating device once the certain condition has existed for the predetermined time whereby the alarm pulses are separated by equal intervals substantially shorter than the predetermined time. The alarm of the instant invention is simple in construction and inexpensive.

18 Claims, 7 Drawing Figures

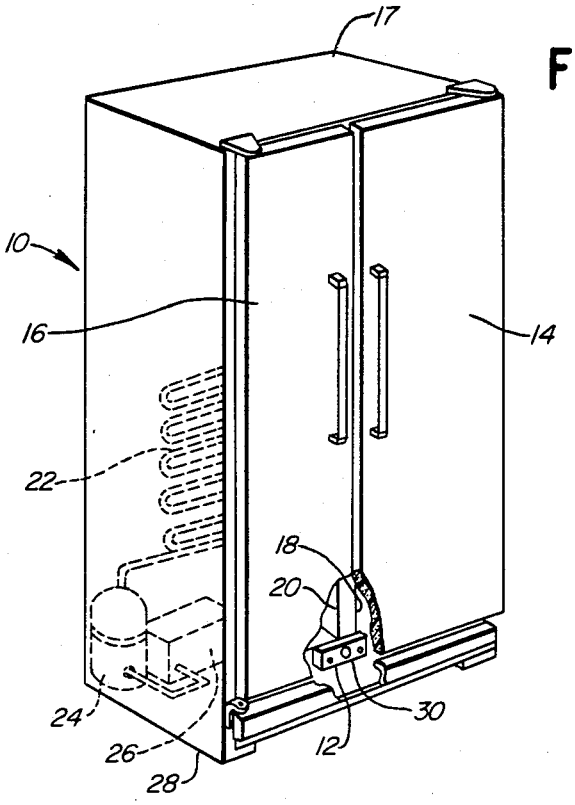
FIG. 1
FIG. 4
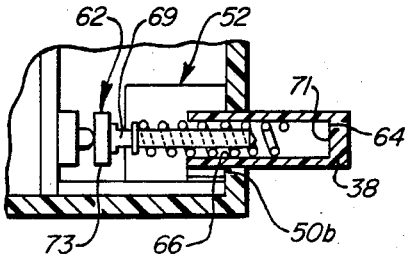
FIG. 2
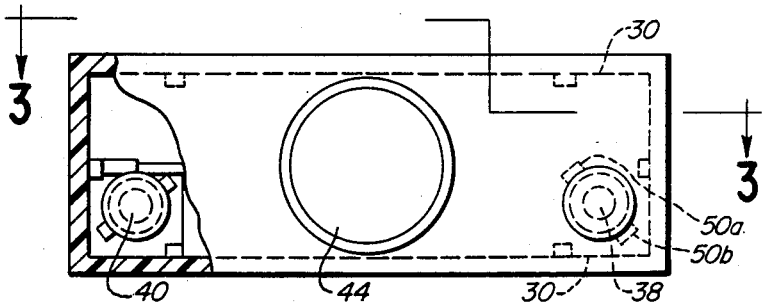
FIG. 3
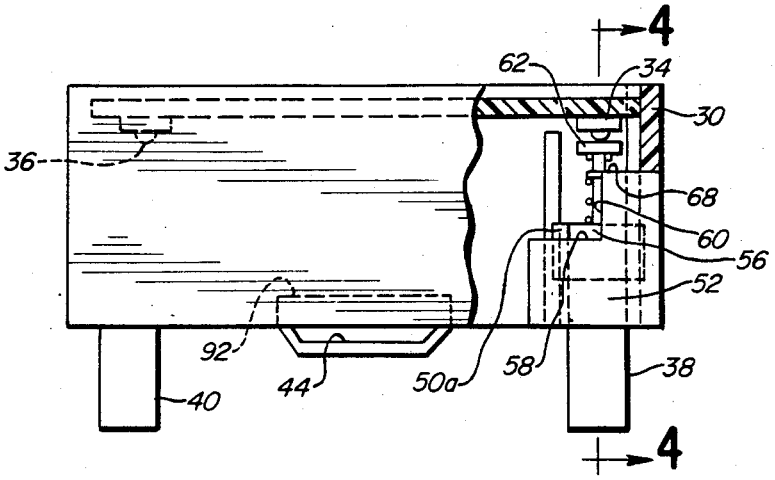

ALARM FOR A REFRIGERATOR

DESCRIPTION

1. Technical Field

The present invention relates generally to alarm or warning devices, and more particularly to a device for providing an indication when a potentially undesirable condition of a refrigerator has arisen.

2. Background Art

Generally, it has been found desirable to provide an indication when a certain condition has arisen and has persisted for a particular length of time. For example, in a refrigerator, it is advisable to warn a user that one of the doors of the refrigerator has been opened for a length of time which may adversely affect the temperature regulation of the refrigerated air space and thereby cause a spoilage of food stored therein. The period of time before which the warning is generated should not be so short as to result in nuisance warnings but should be selected to be sufficiently short so that a user can take action to negate the possibility of creating unfavorable conditions in the refrigerator.

One type of prior door ajar alarm is disclosed in Paddock U.S. Pat. No. 4,387,578, owned by the assignee of the instant application. This patent discloses an electronic sensing and display system for a refrigerator which includes an alarm which is sounded if a door has been left ajar for three minutes. This door ajar alarm, however, is implemented as part of a highly sophisticated control circuit which is microprocessor-based and which requires a separate DC power supply. These components are expensive and therefore render the alarm economically prohibitive to include in a refrigerator as a stand-alone feature.

A further type of alarm is disclosed in Sutcliffe et al U.S. Pat. No. 3,971,017. This patent discloses first and second capacitors coupled in series across an alternating current power source, a diode connected in parallel across the second capacitor and a series connection of an actuating coil of an alarm device and a voltage controlled switch coupled in parallel across the diode. In operation, a halfwave AC voltage is developed across the second capacitor which is periodically discharged by operation of the voltage sensitive switch through the actuating means of the alarm. This alarm circuit causes the alarm to provide alarm pulses at a repetition rate equal to the frequency of the AC source.

A still further type of alarm apparatus is disclosed in LaMell et al U.S. Pat. No. 4,160,972. This patent discloses the use of a normally open magnetic reed switch which is held in a closed position when a magnet is in the proximity thereof. While in the closed position, the reed switch shorts a timing capacitor in an alarm circuit. When the magnet moves out of the vicinity of the reed switch, the switch opens so that the capacitor is allowed to charge to a level which causes an alarm to sound.

A keyboard actuator for a membrane switch is disclosed in U.S. Pat. No. 4,515,999. The actuator is comprised of a helical spring disposed between a cap member and an actuating stem. The purpose of the spring, however, is to absorb the force exerted on the cap member before the cap member contacts and moves the actuating stem.

A dome switch is actuated directly by a helical spring in Pounds U.S. Pat. No. 4,468,542. In the disclosed actuator, the helical spring is at all times maintained under compression.

SUMMARY OF THE INVENTION

In accordance with the present invention, an alarm which is simple and inexpensive in construction provides an indication when a certain condition has existed for a predetermined time.

The alarm includes a capacitor, means coupled to the capacitor for charging same while the certain condition is in existence, an indicating device and energy transfer means in the form of a voltage sensitive switch coupled to the capacitor and to the indicating device. The voltage sensitive switch repetitively partially discharges the capacitor through the indicating device when the charge on the capacitor reaches a particular level so that a series of alarm pulses are developed by the indicating device once the certain condition has existed for the predetermined time, the alarm pulses being separated by equal intervals substantially shorter than the predetermined time.

In the preferred embodiment the charging means comprises a series combination of a diode and a resistor coupled to an AC voltage source. One or more switches are coupled across the capacitor and remain in a closed state to prevent charging of the capacitor until the certain condition arises. Once the condition arises, one or more of the switches open to permit charging of the capacitor.

The instant alarm is particularly adapted for use in a refrigeration device whereby the condition comprises opening of one or more doors of the refrigerator and wherein it is most desirable to be able to sense and provide an indication upon a door being ajar a small distance such as one quarter of an inch.

In the preferred embodiment, the voltage sensitive switch comprises a diac while the indicating device comprises a piezoelectric acoustical alarm. The indicating device is series connected in the circuit with the charging means and the capacitor. A diode is connected across the indicating device and poled in the direction of the charging current. The voltage sensitive switch is series connected in a loop comprising the capacitor and the indicating device. The arrangement of such elements results in an audible "chirping" sound which is highly noticeable to a user.

In alternative embodiments of the invention, the alarm circuitry is combined with a visual indicator for indicating the operative status of the refrigerator and may be further combined with a temperature sensor for causing the visual indicator to operate in a warning mode of operation indicating that an undesirable temperature condition exists within the refrigerator.

The switches coupled across the capacitor, due to the nature of the voltage applied to the capacitor can be low cost DC switches which result in a simple and inexpensive alarm circuit.

BRIEF DESCRIPTION OF THE DRAWINGS

FIG. 1 is a perspective view of a refrigerator incorporating the alarm of the present invention;

FIG. 2 is a front elevational view of the alarm housing shown in FIG. 1;

FIG. 3 is a sectional view taken generally along lines 3—3 of FIG. 2;

FIG. 4 is a partial sectional view taken along the lines 4—4 of FIG. 3;

DESCRIPTION OF THE PREFERRED EMBODIMENT

Figure 5:
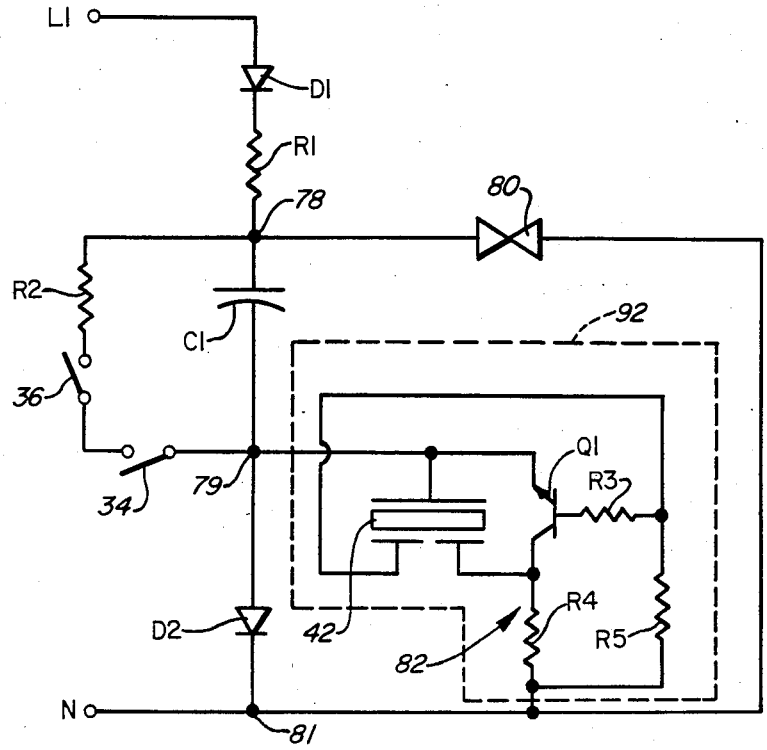
FIG. 5 is a schematic diagram of circuitry for implementing the preferred embodiment alarm of the present invention.

Referring now to FIG. 1, there is illustrated a refrigerator 10 which includes an alarm 12 according to the present invention. While the alarm 12 is disclosed in connection with a refrigerator, it should be noted that the alarm is useful with other devices where it is desirable to provide an indication when a certain condition of the device has arisen and has persisted for a particular length of time.

The refrigerator 10 includes a fresh food access door 14 and a freezer access door 16 which, in conjunction with a cabinet 17, enclose a fresh food compartment 18 and a freezer compartment 20, respectively. The fresh food compartment 18 and the freezer compartment 20 are cooled by cooling apparatus which comprises an evaporator 22, a compressor 24 and a condenser 26, as is conventional.

Mounted on a lower portion of the cabinet 17 is an alarm housing 30, illustrated in greater detail in FIGS. 2–4. Referring to FIGS. 2 and 3, the housing encloses a printed circuit board 32 and first and second switches 34,36 having actuating plungers 38,40, respectively. In the preferred embodiment, the switches 34,36 comprise keyboard-type switches. Also disposed within the housing 30 is an indicating device 92 in the form of an acoustical piezoelectric transducer 42. The indicating device 92 is mounted behind an opening 44 in the housing 30 so that sound produced by the transducer 42 can emanate therefrom.

As seen specifically in FIG. 1, the housing 30 is disposed in relation to the doors 14,16 so that a portion of each door, when fully closed, contacts and depresses one of the plungers 38,40 to close the associated switch 34,36, respectively. When one or both of the doors 14,16 is open, the associated switch 34,36 is open as well.

As seen in FIG. 4, plunger 38 is hollow, having a recess 66 extending essentially its entire length. Disposed within recess 66 is a helical spring 64. Disposed within spring 64 is a narrow portion 69 of a switch actuating pin 62. With plunger 38 extended fully outward and the associated actuating pin abutting its associated switch 34, the length of the spring is less than the distance between a distal end 71 of the plunger and an enlarged portion 73 of the associated actuating pin.

Inward axial movement of plunger 38, which is a result of the associated door moving to a closed position, will compress spring 64 causing the enlarged portion of the actuating pin to assert sufficient force on switch 34 to close the contacts. In addition, spring 64 will absorb any movement of the door, and hence the plunger, that is in excess of the movement of the actuating pin.

When door 14 is moved to an open position, spring 64 will move plunger 38 outwardly until blades 50*a* and 50*b* mounted to the plunger contact an inner surface of housing 30, preventing further outward movement of the plunger. This relieves the tension on the spring allowing switch 34 to open under the force of its internal spring. Because spring 64 is shorter in length than the distance between the distal end of the plunger and the enlarged portion of the associated actuating pin, it will not be possible to have any residual compression force stored in the spring when door 14 is open. This assures that, no matter how sensitive switch 34 is to actuating forces, the switch will not be hindered from opening each and every time the respective door is open. This permits the use of sensitive keyboard-type switches in the alarm. Further, switch 34 will open in about $\frac{1}{4}$ inch of plunger movement which enhances the sensitivity of the alarm to the door being open a small distance.

The operation of plunger 40 and switch 36 is identical to that just described for plunger 38 and switch 34.

Means are provided for locking each of the switches 34,36 in a closed position irrespective of the position of the associated door 14 or 16. Such means comprises the blades 50a disposed on each plunger 38,40 and a stepped platform 52 disposed on inner walls of the housing 30. In normal operation, the plunger is in the position shown by the solid lines of FIG. 3 whereby the blade can travel freely in a recess 56 defined by platform edges 58,60, respectively. The plungers 38,40 can, however, be rotated to cause the respective blade 50*a* to be captured behind a further surface 68 of the platform 52. This capturing prevents outward axial travel of the plungers 38,40 and maintains the associated switch 34,36 in the closed position even while the associated door 14,16 is open.

This feature permits disabling of the alarm while servicing of the refrigerator is taking place or for any other reason.

Referring now to FIG. 5, there is illustrated a schematic diagram of circuitry disposed on the circuit board 32 for implementing the alarm of the present invention. The circuitry includes charging means in the form of a diode D1 and a resistor R1 which are coupled to an AC voltage line L1. The diode D1 and resistor R1 are coupled to a capacitor C1 and provide direct supply current thereto at a first terminal 78. A resistor R2 and the switches 34,36 are connected in parallel across the capacitor C1.

The capacitor C1 is in turn coupled to a diode D2 at a second terminal 79. Diode D2 couples second terminal 79 to a second AC voltage line N at 81. A voltage sensitive switch 80 in the form of a diac is coupled across the series combination of the capacitor C1 and the diode D2.

Coupled in parallel across the diode D2 is an indicating device 92 comprising a piezoelectric transducer 42 and feedback circuitry 82 for driving the transducer. The circuitry 82 includes a transistor Q1 and resistors R3-R5 which provide proper biasing voltages therefor. The transducer 42 and circuitry 82 together comprise an audible oscillator circuit which operates as described in U.S. Pat. No. 4,139,842 which is hereby incorporated herein by reference.

In the preferred embodiment, the transducer 42 and the driving circuitry 82 are provided in a single compact housing and are manufactured by MuRata Erie of Marietta, GA under Part No. PKB8-4A0 or PKB9-3A0.

In operation, when both of the refrigerator doors 14,16 shown in FIG. 1 are closed, both of the switches 34,36 are also closed, in turn maintaining the capacitor C1 in a discharged state. If, however, one or both of the doors 14,16 is opened and the associated switch plunger 38,40 is not locked in the closed position, one or both of the switches 34,36 is opened. This causes an exponential voltage rise to occur across the capacitor C1. The rate of voltage increase across the capacitor is a function of the resistance of the resistor R1 and the capacitance of the capacitor C1. In the preferred embodiment, the resistor R1 has a high resistance value of 1 megohm while the capacitor C1 has a capacitance of 220 microfarads. These values cause the voltage across the capacitor C1 to reach the break over level of the diac 80 approximately 80 seconds after opening of one or both of the switches 34,36.

Until the break over voltage of the diac 80 is reached, the diode D2 is forward biased so that it conducts the supply current, thereby causing the transistor Q1 in the driving circuit 82 to be reverse biased and preventing energization of the indicating device 92. When, however, the break over voltage level of the diac 80 is reached at the end of a delay interval determined by the values of the components R1 and C1, the capacitor C1 is partially discharged through the diac 80, in turn causing the piezoelectric transducer 42 in conjunction with driving circuitry 82 to generate an output signal in the form of a sound burst or alarm pulse. Conduction of the diac 80 also back-biases the diode D2.

Once the capacitor discharges sufficiently to bring the voltage across the diac 80 below its break over level, the diac 80 reverts to the nonconducting state. This removes the driving voltage from the indicating device. The capacitor C1 thereafter charges back to the break over voltage level of the diac 80, at which point the diac 80 again conducts to cause the indicating device 92 to generate another sound burst.

In effect, capacitor C1, diac 80, indicating device 92 and diode D2 comprise an oscillator circuit generating sound bursts or alarm pulses separated by equal intervals which are relatively short compared with the time it takes for the capacitor C1 to charge from a fully discharged condition. That is, the alarm pulses are separated by equal intervals which are substantially shorter than the predetermined time before which an alarm is sounded following opening of one or both of the doors 14,16.

One particular advantage of the intermittent sound produced by the alarm of the instant invention is that the sound bursts are "crisp", i.e. the leading and trailing edges of the sound envelope are steep. Moreover, the relatively short interval between sound bursts in conjunction with the relatively steep leading and trailing portions of the sound envelope result in a highly noticeable sound to the user.

The diac 80 does not act as an ideal switch, i.e. one which has a zero voltage drop in the conducting state. Rather, the voltage drop across the diac 80, at the instant of conduction, decreases only by about 25%. The steep leading and trailing edges of the sound envelope is surprising in view of this fact and the additional fact that the relatively inexpensive voltage switch comprising the diac 80 begins leaking current before the breakdown voltage is actually reached. These two factors would seem to indicate that the leading and trailing edges of the sound bursts should be relatively gentle in slope and not steep.

One theory as to why the instant invention produces this result is as follows. As the capacitor C1 is charging and begins to approach the break over voltage of the diac 80, any leakage current through the diac is shunted to ground and not through the transistor Q1 and the transducer 42. Once break over begins, the diode D2 becomes reverse-biased and rapidly ceases conduction, thereby allowing rapid discharge of the charge on the capacitor C1 to the indicating device 92. During generation of the sound burst from the transducer 42, the reverse-biased diode D2 prevents the supply current from adding to the charge on the capacitor C1, so that the charge on the capacitor C1 is rapidly "dumped" through the diac 80 to the drive circuit 82 and the transducer 42. This quick release of charge from the capacitor C1 also results in rapid turnoff of the diac 80 once the voltage thereacross has dropped below the break over level.

It is also believed that the nature of the piezoelectric transducer assists in resetting the diac to the nonconductive state due to the negative current pulses produced by the transducer 42 during oscillations thereof.

While the piezoelectric transducer 42 appears to interact with the diac 80 to produce the steep leading and trailing edges of the sound burst envelope, it should be noted that the present invention comprehends the use of other types of indicating devices, such as a buzzer or a lamp.

The alarm is reset by momentarily closing both of the switches 34,36 to discharge the capacitor C1 completely through the resistor R2. Subsequent opening of one or both of the switches 34,36 will again cause charging of the capacitor C1 in the fashion noted above so that the alarm is provided a predetermined time following such opening.

It should be noted that, in the event the instant invention is used with a refrigerator having only one door, or where it is desired to use the instant invention to sense a single condition, the two switches 34,36 shown in FIG. 5 may be replaced by a single switch which is responsive to the existence of the condition.

It should also be noted that, although the circuit is energized by AC line voltage from a 110 volt AC source, each of the switches 34,36 may be an inexpensive 20 volt DC switch. Due to the low current drain of the circuit, even when the switches 34,36 are closed, the circuit can be kept in connection with the AC line voltage obviating the need for the door sensing switches to be AC line voltage switches. Such low voltage, keyboardtype switches are highly sensitive to slight variations in the position of the doors 14,16 which insures that a potentially undesirable condition will not go unnoticed.

Of further advantage is the fact that the diode D1, resistor R1 and capacitor C1 perform multiple functions. These components provide the initial time delay before the alarm is sounded and function as a DC power supply for the oscillating circuit for driving indicating device 92 once it starts operation. Also, the capacitor C1 is an integral part of the oscillator circuit for driving the indicating device 92 and interacts with the diac 80, the diode D2 and the transducer 42 to provide the series of sound bursts.

Figure 6:
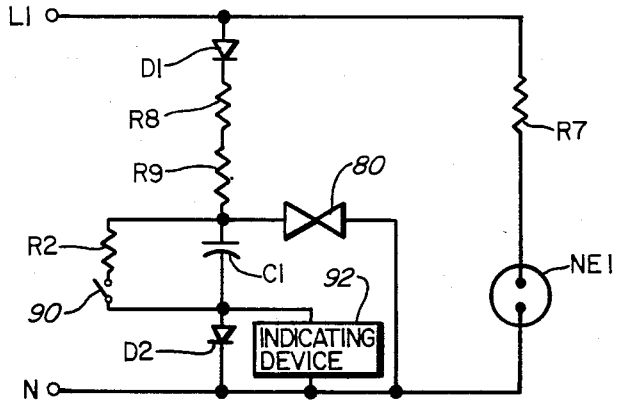
FIGS. 6 and 7 are schematic diagrams of alternative embodiments of the alarm of the present invention.

Referring now to FIG. 6, there is illustrated a further embodiment of the invention wherein elements in common with FIG. 5 are assigned like reference numerals. In the embodiment shown in FIG. 6, the two switches 34,36 are replaced for the sake of simplicity by a single switch 90 which is adapted to sense a predetermined condition of the refrigerator, such as opening of one of the doors thereof. Moreover, resistor R1 is replaced by resistors R8 and R9, each one-half the resistance of R1, in order to lessen the amount of current that would develop in the circuit should a short develop across a resistor.

The embodiment of FIG. 6 further differs from the embodiment of FIG. 5 in that a resistor R7 and a neon lamp NE1 are coupled across the power terminals L1 and N to provide an indication when the refrigerator is coupled to the AC power source. By combining this "power on" light with the alarm circuitry disclosed above in connection with FIG. 5, the cost of the lamp is reduced as is the mounting cost thereof.

Figure 7:
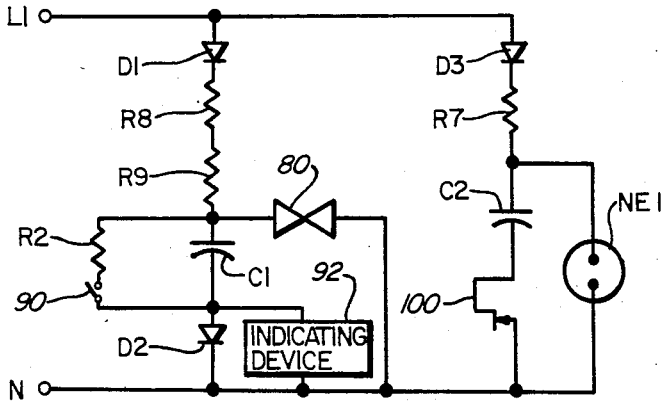

Referring now to FIG. 7, the circuitry shown in FIG. 6 may be modified to produce an indication when the temperature within the refrigerated compartment has risen above a particular level indicative of an abnormal temperature condition. A series combination of a capacitor C2 and a thermal switch 100 are coupled in parallel across the neon lamp NE1. The thermal switch 100 is positioned within a refrigerated compartment and is adapted to sense the temperature therein. A diode D3 is coupled in series with the resistor R7 and the parallel combination of the neon lamp NE1 and the capacitor C2 and switch 100.

When the temperature in the refrigerated compartment sensed by the thermal switch 100 is below the predetermined temperature, the switch 100 is open, in turn causing the neon lamp NE1 be constantly illuminated. If, however, the temperature within the refrigerator compartment rises above the predetermined temperature, the thermal switch 100 closes, in turn coupling the capacitor C2 in parallel with the neon lamp NE1 to form a relaxation oscillator. The neon lamp NE1 then flashes to indicate to a user the existence of a potentially undesirable condition in the refrigerated air space.

In addition to the door ajar warning previously described, the embodiment of FIG. 7 provides an indication that power is not being supplied to the refrigerator by virtue of the lamp not being illuminated, and provides an indication, utilizing the same lamp, that an undesirable temperature condition exists even though power is being properly supplied.

We claim:

1. An alarm for providing an indication when a certain condition has existed for a predetermined time, comprising:

a capacitor;

means coupled to the capacitor for charging same while the certain condition is in existence;

an indicating device; and a voltage-sensitive switch coupled to the capacitor and to the indicating device for repetitively partially discharging the capacitor through the indicating device when the charge on the capacitor reaches a particular level whereby a series of alarm pulses are developed by the indicating device once the certain condition has existed for the predetermined time, the alarm pulses being separated by equal intervals substantially shorter than the predetermined time.

2. The alarm of claim 1, wherein the charging means comprises a series combination of a diode and resistor coupled to an AC source.

3. The alarm of claim 1, wherein the voltage-sensitive switch comprises a diac.

4. The alarm of claim 1, wherein the output device comprises a piezoelectric transducer and a driving circuit coupled to the transducer.

5. The alarm of claim 1, wherein the certain condition comprises opening of a door of a refrigerator.

6. The alarm of claim 2, wherein the certain condition comprises opening of a door of a refrigerator connectable to the AC source and further including an indicating lamp for indicating when the refrigerator is energized by the AC source.

7. The alarm of claim 6, wherein the indicating lamp comprises a neon lamp and further including a series connection of a capacitor and a thermal switch coupled in parallel across the neon lamp to define a parallel combination and a resistor and diode coupled in series with the parallel combination whereby the thermal switch is open when the temperature within a refrigerated compartment of the refrigerator is below a predetermined temperature so that the neon lamp is steadily illuminated and whereby the thermal switch is closed when the temperature within the refrigerated compartment is above the predetermined temperature so that the neon lamp flashes to warn a user of an undesirable temperature condition.

8. A door ajar alarm for producing an output at a particular repetition rate after a door has been in an open position for a predetermined period of time, comprising:

an oscillator comprising a capacitor in series with an indicating device and energy transfer means, said energy transfer means periodically transferring energy stored in the capacitor to the output device as a series of pulses at a repetition rate determined in part by the capacitance value of the capacitor;

charging means for charging said capacitor;

said oscillator operative to produce an output only when the voltage across said capacitor exceeds a predetermined magnitude, the rate of voltage increase across the capacitor due to charging thereof being determined in part by the capacitance value of the capacitor;

said capacitance value being preselected so that a delay period occurs after the door has been placed in an open position before the alarm output is produced, such delay period being much greater than the interval between pulses.

9. The door ajar alarm of claim 8, further including switch means responsive to the position of the door for allowing said charging means to develop a voltage across said capacitor only when the door is in the open position.

10. An alarm capable of producing repetitive, intermittent output signals in response to direct supply current induced between first and second terminals, comprising:

a capacitor and an output device connected in series between said terminals;

a rectifier connected across said output device and poled to conduct said supply current; and a voltage sensitive conduction device connected across said terminals, whereby an interval between output signals is produced when the voltage across the terminals is sufficiently small to prevent conduction by the conduction device during which time the capacitor is being charged by the supply current which is shunted around the output device through the rectifier and whereby an output signal is produced by discharge of the capacitor through the output device when the voltage across the terminals is sufficiently large to cause the conduction device to conduct.

11. The alarm device of claim 10, further including a second diode and a resistor connected in series between an AC supply terminal and said first terminal for producing the direct supply current.

12. The alarm device of claim 10, further including a normally closed switch across said capacitor to prevent the production of output signals when the switch is closed.

13. The alarm device of claim 12, wherein the switch is operated by the access door of a refrigeration device.

14. The alarm device of claim 10, wherein the output device is a piezoelectric transducer.

15. An alarm for a refrigerator having a compartment defining an opening and a door selectively closing said opening comprising:

a switch having an engaged state and a disengaged state and biased toward the disengaged state, alarm means responsive to said switch in said disengaged state to produce an alarm signal, and switch actuation means responsive to the position of said door for moving said switch between an engaged state when said door is closing said opening and a disengaged state when said door is not closing said opening, said switch actuation means comprising an actuating pin defining an enlarged portion abutting said switch, an actuating plunger having a surface spaced from said enlarged portion of said actuating pin a predetermined distance in a direction away from said switch when said door is not closing said opening, and a spring axially disposed between said surface and said enlarged portion and dimensioned in the axial direction less than said predetermined distance.

16. The alarm of claim 15 wherein said spring is a helical spring.

17. The alarm of claim 16 wherein said actuating pin further defines a narrow portion disposed within said spring.

18. The alarm of claim 16 wherein said plunger defines a hollow portion and said spring is disposed within said hollow portion.

* * * * *